United States Patent [19]

Watanabe

[11] Patent Number: 4,695,154

[45] Date of Patent: Sep. 22, 1987

[54] IMAGE FORMING APPARATUS WITH DOCUMENT SIZE DETECTION

[75] Inventor: Junji Watanabe, Yokohama, Japan

[73] Assignee: Kabushiki Kaisha Toshiba, Kawasaki, Japan

[21] Appl. No.: 811,872

[22] Filed: Dec. 20, 1985

[30] Foreign Application Priority Data

Dec. 25, 1984 [JP] Japan ..... 59-278422
Dec. 27, 1984 [JP] Japan ..... 59-278228

[51] Int. Cl.[4] ..... G03G 15/00

[52] U.S. Cl. ..... 355/8; 355/3 R; 355/14 R; 355/14 E; 355/14 SH

[58] Field of Search ..... 355/8, 3 R, 14 R, 14 E, 355/14 SH, 35, 41

[56] References Cited

U.S. PATENT DOCUMENTS 3,926,518 12/1975 Berry et al. ..... 355/8
4,200,391 4/1980 Sakamoto et al. ..... 355/14 E
4,239,374 12/1980 Tatsumi et al. ..... 355/14 E
4,338,020 7/1982 Yukawa et al. ..... 355/41
4,354,758 10/1982 Futaki ..... 355/14 E
4,472,046 9/1984 Kohyama ..... 355/3 R X

FOREIGN PATENT DOCUMENTS 3043677 9/1981 Fed. Rep. of Germany .
3341774 5/1984 Fed. Rep. of Germany .
3522089 1/1986 Fed. Rep. of Germany .
3538052 4/1986 Fed. Rep. of Germany .

*Primary Examiner*—A. C. Prescott
*Attorney, Agent, or Firm*—Schwartz, Jeffery, Schwaab, Mack, Blumenthal & Evans

[57] ABSTRACT

A document scanning unit obtains image data by optically scanning the document. In an initial state, a first control unit sets the document scanning unit at a predetermined position, and sets a light emitting and receiving unit at a predetermined position. A second control unit causes the document scanning unit to move from the predetermined initial position in accordance with an instruction from a document size detection instruction unit prior to the image formation instruction. A first detection unit detects, as a change in amount of light received by the light receiving section, that the light emitting and receiving unit has reached one side portion of the document. A third control unit causes the light emitting and receiving unit to move from the predetermined initial position in accordance with a detection signal from the first detection unit. A second detection unit detects, as a change in amount of light received by the light receiving section, that the light emitting and receiving unit has reached the other side portion of the document. A document size calculating unit calculates two dimensions of the document based on the detection signals from the first and second detection units.

24 Claims, 31 Drawing Figures

FIG. 10
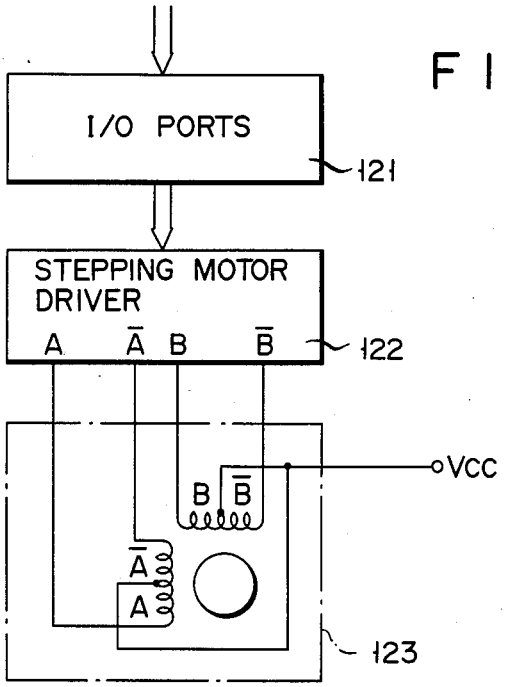
FIG. 11A
FIG. 11B
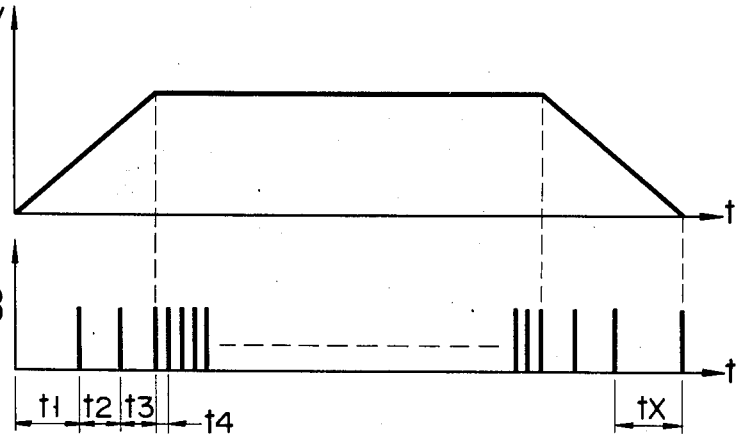

30a
30e
30f
30j
30k
30g
30h
30i
30b
30c
30d
30A
30
30
30

IMAGE FORMING APPARATUS WITH DOCUMENT SIZE DETECTION

BACKGROUND OF THE INVENTION

This invention relates to an image forming apparatus with document size detection and, more particularly, to an image forming apparatus most suitable for, e.g., an electronic copying machine which optically scans a document to obtain image data to be formed.

As is well known, in electronic copying machines, a detection means for detecting a document size placed on a document table (transparent glass) has been developed. The detecting means has a plurality of light emitting elements and light receiving elements installed at the back surface side of the document table along the longitudinal direction thereof. A document cover is closed and light is radiated from the light emitting elements onto the document table. Light reflected from a document placed on the document table and the document cover is detected by the light receiving elements. A document size is determined by detecting level changes in output signals of the light receiving elements.

In the conventional arrangement, the light emitting and receiving elements corresponding to a document size must be installed at the back surface side of the document table. Therefore, a large number of light emitting and receiving elements are required. In addition, space for installing these elements must be guaranteed.

Furthermore, a surface of the document cover facing the document table is normally white. When the above detection operation is performed while the document cover is closed, there is no significant difference between amounts of light reflected from a document and the document cover. Therefore, it is difficult to reliably detect the document size.

An electronic copying machine normally has a function for copying a document image on a copying sheet with or without a reduction or enlargement mode. If a document image has an unnecessary portion for image formation, a conventional copying machine cannot copy an image without the unnecessary portion.

SUMMARY OF THE INVENTION

It is, therefore, an object of the present invention to provide a new and improved image forming apparatus with document size detection, which has a simple structure, requires a small installation space for parts, and can accurately and easily detect dimensions of a document.

It is another object of the present invention to provide an image forming apparatus which can accurately detect dimensions of a document with a simple structure, and form an image by selectively erasing an unnecessary portion of a document.

According to the present invention, there is provided an image forming apparatus with document size detection, the apparatus comprising:

a document table on which a document subjected to image formation is placed at one end side thereof;

image formation instruction means for supplying an image formation instruction;

document scanning means, movable along the document table, for scanning the document from the one end side to the other end side of the document table to obtain image data in accordance with the image formation instruction;

light emitting and receiving means provided on the document scanning means to be movable along a direction perpendicular to a moving direction of the document scanning means, and including a light emitting section for emitting light in a direction of the document table and a light receiving section for receiving a reflected component of light emitted by the light emitting section;

first control means for, in an initial state, setting the document scanning means at a predetermined initial position on the document table and setting the light emitting and receiving means at a predetermined initial position on the document scanning means;

document size detection instruction means for supplying a document size detection instruction prior to the image formation instruction;

second control means for moving the document scanning means from the predetermined initial position in accordance with the document size detection instruction;

first detection means for detecting a change in amount of light received by the light receiving section, when the light emitting and receiving means has reached one side portion of the document, upon movement of the document scanning means by the second control means;

third control means for moving the light emitting and receiving means from the predetermined initial position in accordance with the detection signal from the first detection means;

second detection means for detecting, upon movement of the document scanning means and the light emitting and receiving means by the first and third control means, a change in amount of light received by the light receiving section when the light emitting and receiving means has reached the other side portion of the document;

document size calculation means for calculating two dimensions of the document based on the detection signals from the first and second detection means;

image forming means for transferring the image data from the document scanning means onto an image forming medium at a predetermined magnification; and fourth control means for generating a control signal required for at least one of the document scanning means and the image forming means based on the calculation result from the document size calculation means.

These and other objects and features of the present invention can be understood through the following embodiments by reference to the accompanying drawings.

BRIEF DESCRIPTION OF THE DRAWINGS

FIG. 1 to FIG. 16 show an embodiment of an image forming apparatus according to the present invention, in which:

FIGS. 1 and 2 are a schematic perspective view and a side sectional view, respectively, showing the construction of the image forming apparatus;

FIG. 3 is a plan view of a control panel;

FIG. 4 is a perspective view showing an arrangement of drive sections;

FIG. 5 is a perspective view schematically showing a drive mechanism for an optical system;

FIG. 6 is a block diagram showing a general control circuit;

FIG. 7 is a functional block diagram of a main processor group;

FIG. 8 is a functional block diagram of a first sub-processor group;

FIG. 9 is a functional block diagram of a second sub-processor group;

FIG. 10 is a block diagram showing a pulse motor control circuit;

FIGS. 11A and 11B are respectively charts for explaining a method of controlling a speed of a stepping motor;

FIG. 12 is a perspective view only showing the principal part of the first embodiment;

FIG. 13 is a side sectional view showing a part of FIG. 12;

FIG. 14 is a side sectional view for explaining an arrangement of light emitting and receiving sections of FIG. 12;

FIG. 15 is a partially cutaway, side sectional view for explaining the operation of a document cover shown in FIG. 1; and FIG. 16 is a plan view for explaining a document size detection operation according to the first embodiment, and FIG. 17 to FIG. 27 show a second embodiment of the present invention, in which:

FIG. 17 is a plan view of a control panel;

FIG. 18 is a block diagram showing the overall control circuit;

FIG. 19 to FIGS. 22A and 22B are plan views for explaining an operation for designating an unnecessary portion of a document as an erasure range using a spot light source;

FIGS. 24 and 25 are a perspective view and a front view, respectively, of only the principal part of the erasure array, showing the relationship between the erasure array and a photosensitive drum;

FIG. 27 is a circuit diagram illustrating the configuration of an array drive section.

DETAILED DESCRIPTION OF THE PREFERRED EMBODIMENTS

Preferred Embodiments of the present invention will be described with reference to the accompanying drawings.

Figure 1:
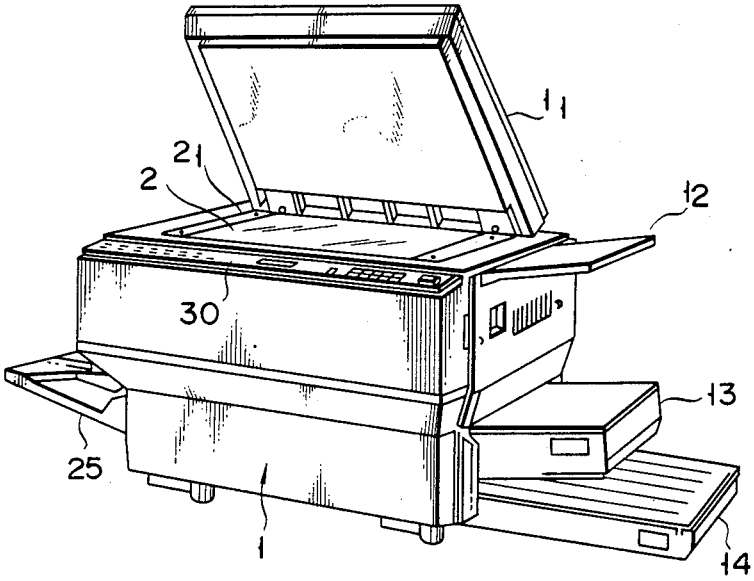
Figure 2:
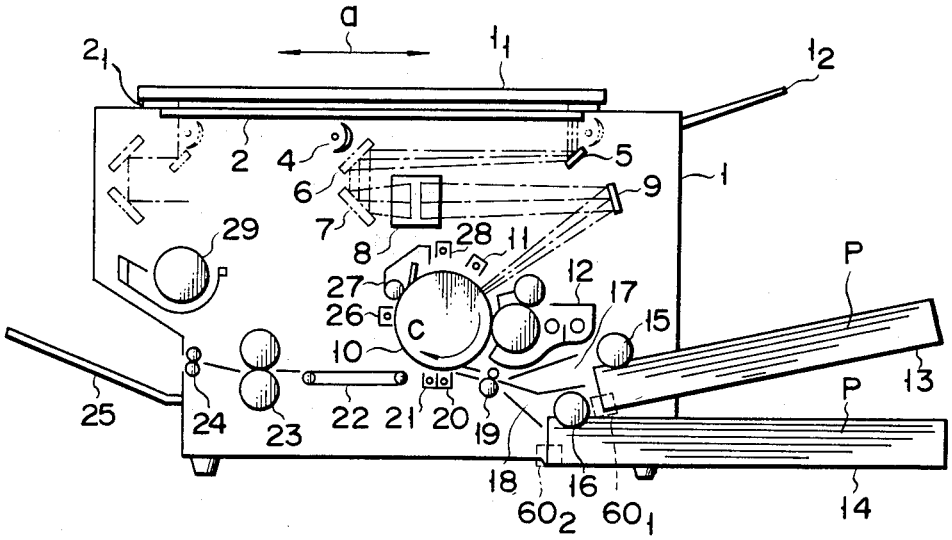

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. A fixed scale $2_1$ as a reference for setting an original is arranged at one end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches 601 and 602 which detect the selected cassette size. The detecting switches 601 and 602 are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Figure 3:
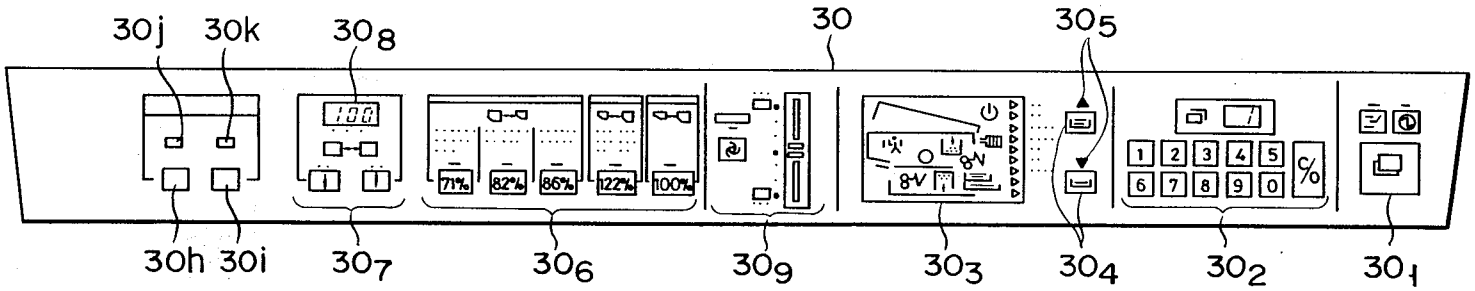

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Reference numeral 30*h* denotes a check key operated when a document size is checked; 30*i*, an automatic magnification change key for checking the document size and for automatically determining a copying magnification so as to form an image corresponding to a paper size; and 30*j* and 30*k*, light emitting display elements respectively illuminated when keys 30*h* and 30*i* are operated.

Figure 4:
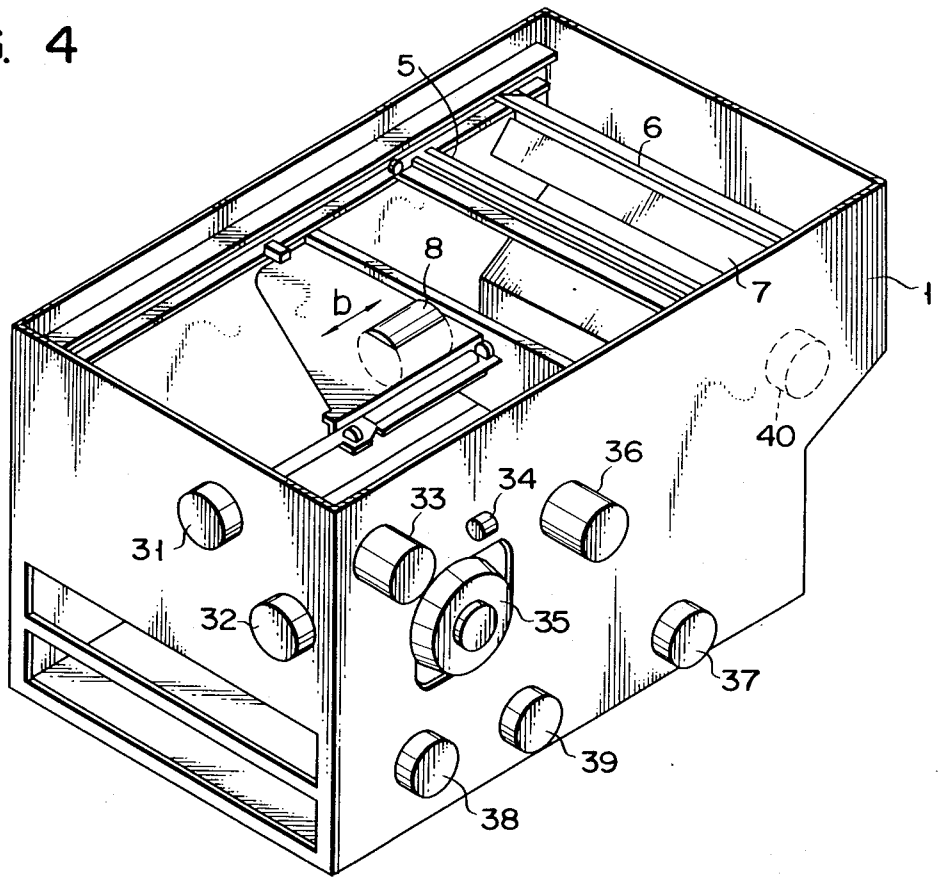

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper-supply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 5:
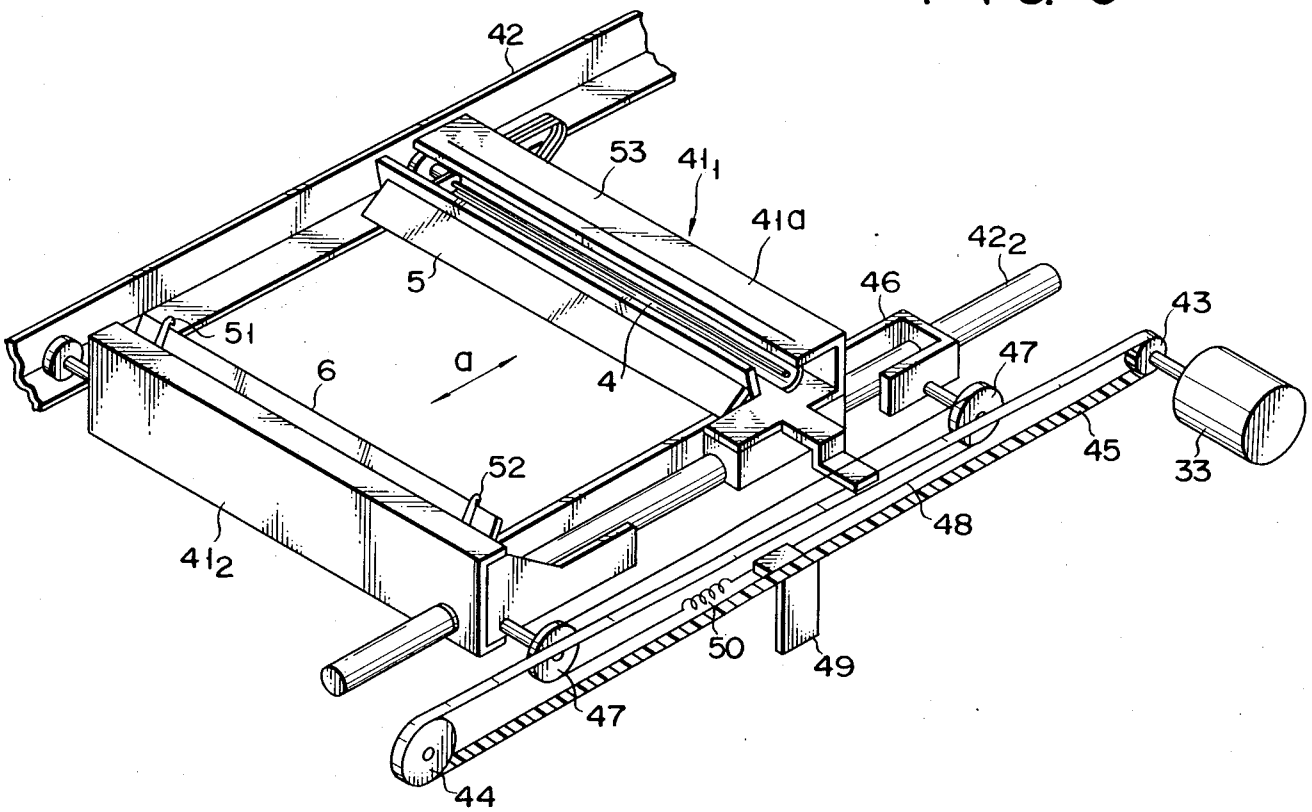

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$. The four-phase pulse motor 33 drives a pulley 43. An endless belt 45 is stretched between the pulley 43 and an idle pulley 44, and one end of the first carriage 411 supporting the mirror 5 is fixed to the middle portion of the belt 45.

On the other hand, two pulleys 47 are rotatably attached to a guide portion 46 (for the rail 422) of the second carriage 412 supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage 411 is fixed to the middle portion of the wire 48.

With this arrangement, when the pulse motor 33 is driven, the belt 45 turns around to move the first carriage $41_1$. As the first carriage $41_1$ travels, the second carriage $41_2$ also travelss. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the pulse motor 33.

When a paper size designated by cassette selection key $30_4$ is given by (Px, Py) and a copying magnification designated by magnification setting keys $30_6$ and $30_7$ is given by K, a copy enable range (x, y) is expressed as follows:

$$x = Px/K$$

$$y = Py/K$$

In the copy enable range (x, y), the x direction corresponds to the lateral direction of document table 2 and the y direction corresponds to the longitudinal direction thereof.

Figure 6:
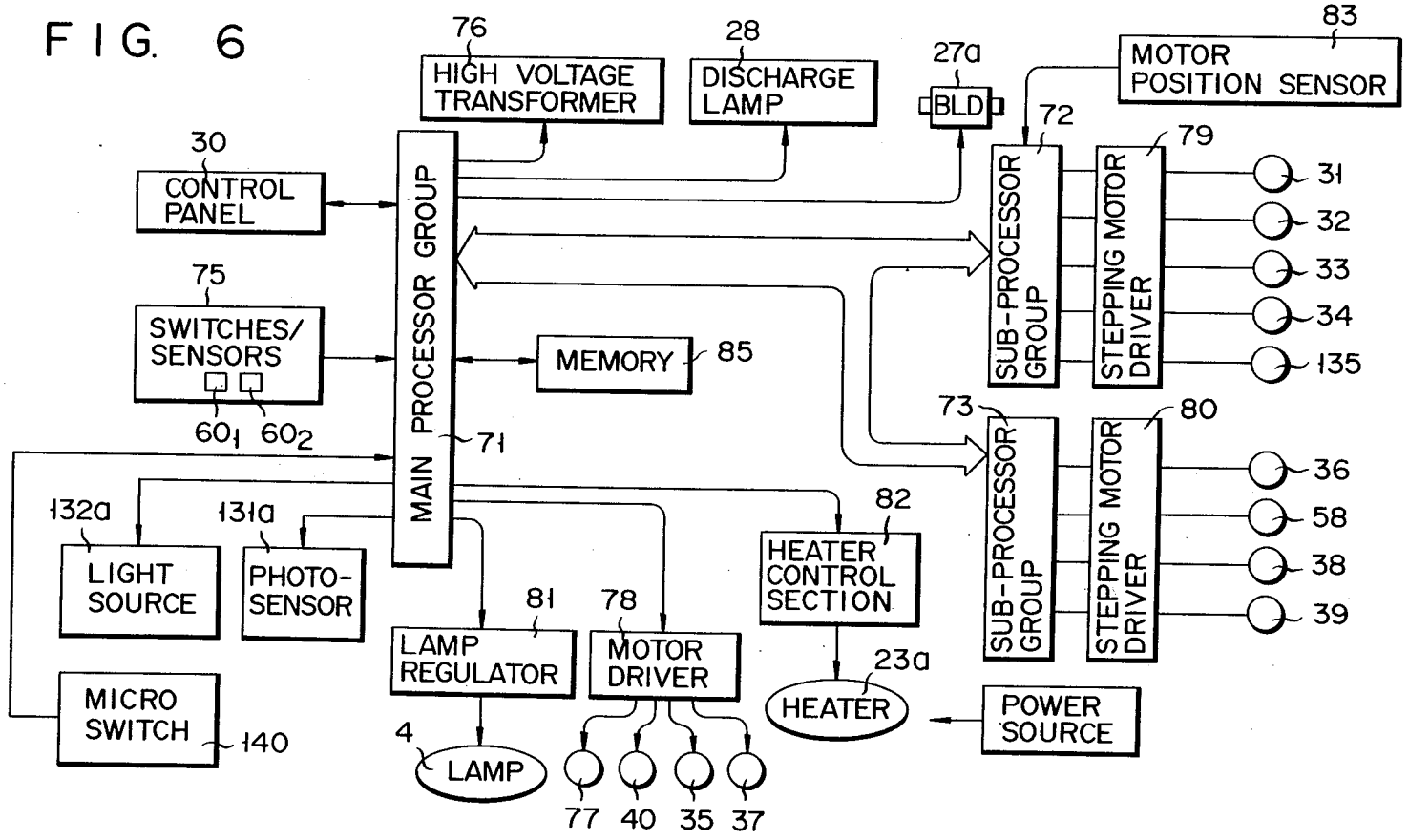

FIG. 6 shows a general control circuit of the electronic copying machine. This control circuit is mainly composed of a main processor group 71 and first and second sub-processor groups 72 and 73. The main processor group 71 detects in accordance with contents of a memory 85 input data from the control panel 30 and a group of input devices 75 including various switches and sensors, such as the cassette size detection switches 601 and 602 and controls a high-voltage transformer 76 for driving the chargers, the discharge lamp 28, a blade solenoid 27*a* of the cleaner 27, a heater 23*a* of the fixing roller pair 23, the exposure lamp 4, and the motors 31 to 40 and 58, thus accomplishing the copying operation. Main processor group 71 performs document size detection upon control of light emitting section 131 and light receiving section 132 as a first detection part (to be described later), stepping motor 135 for driving these sections, and micro switch 140 as a second detection means.

The motors 35, 37 and 40 and a toner-supply motor 77 for supplying the toner to the developing unit 12 are connected through a motor driver 78 to the main processor group 71 to be controlled thereby. The motors 31 to 34 and 95 are connected through a stepping motor driver 79 to the first sub-processor group 72 to be controlled thereby. The motors 36, 39 and 38 are connected through a stepping motor driver 80 to the second sub-processor group 73 to be controlled thereby.

Further, the exposure lamp 4 is controlled by the main processor group 71 through a lamp regulator 81, and the heater 23*a* by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34.

Figure 7:
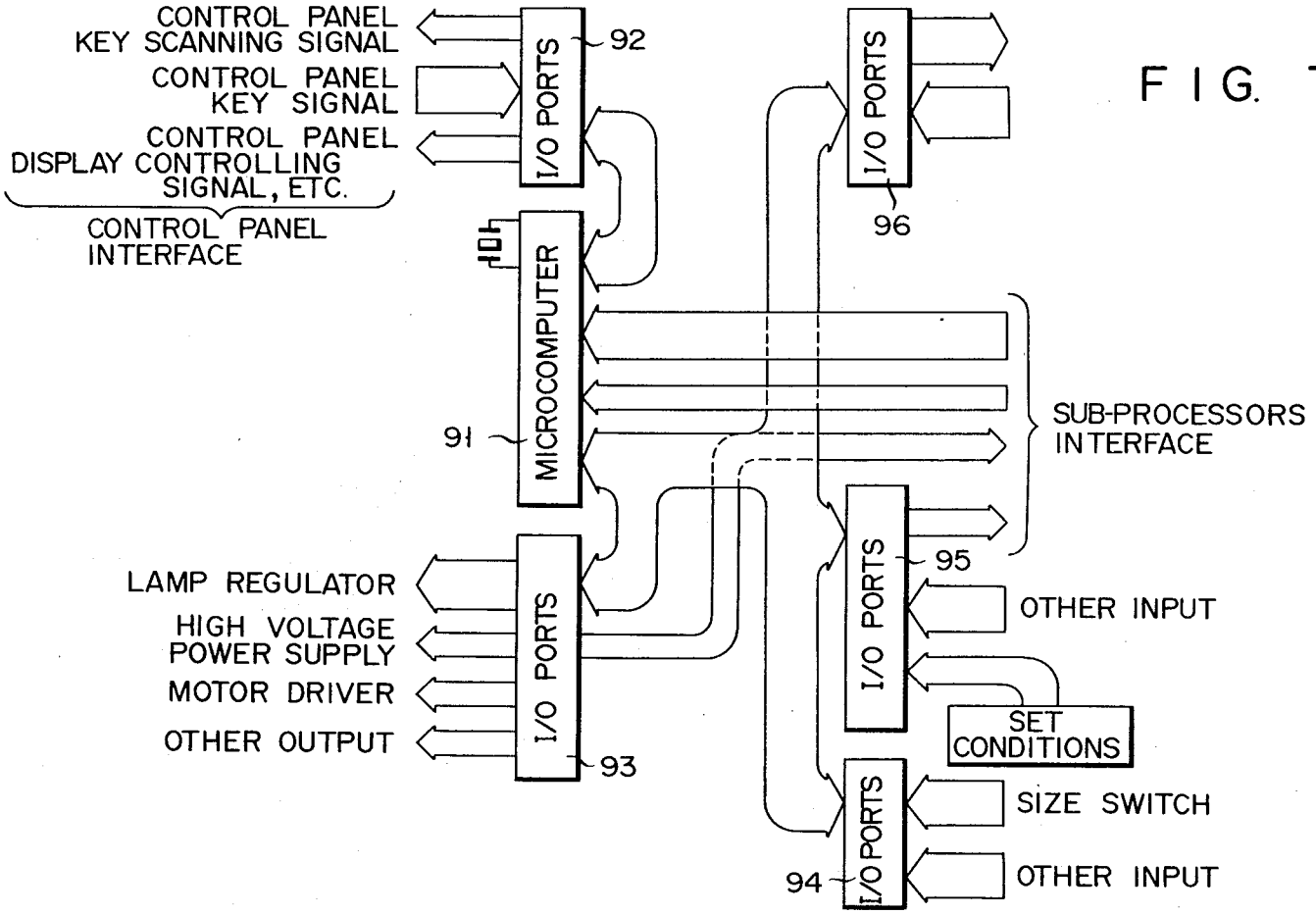

FIG. 7 shows an arrangement of the main processor group 71. Reference numeral 91 denotes a one-chip microcomputer (to be referred to as a CPU hereinafter). The CPU 91 detects key inputs at a control panel (not shown) through an I/O port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 8:
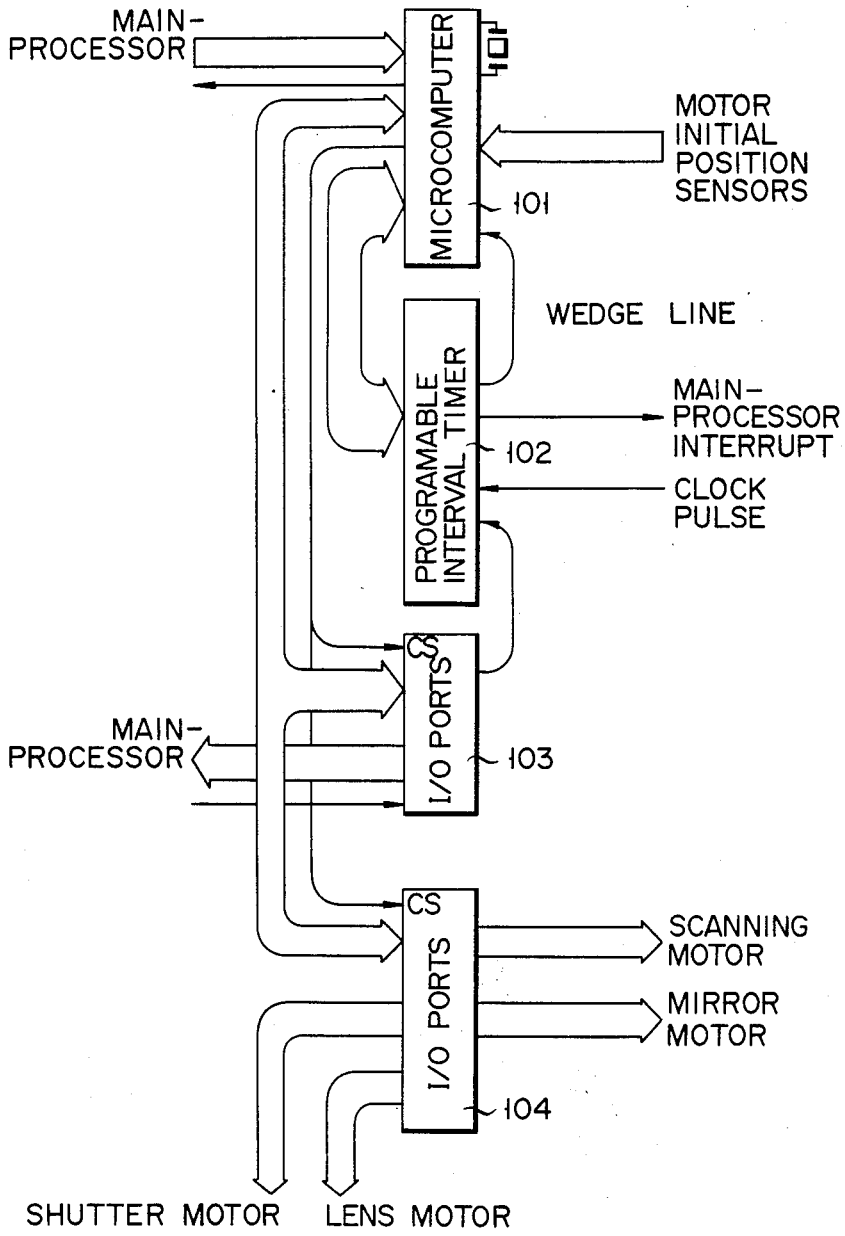

FIG. 8 shows an arrangement of the first sub-processor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34 and 135 through the stepping motor driver 79. The port 103 is used to supply a status signal from each pulse motor to the group 71.

Figure 9:
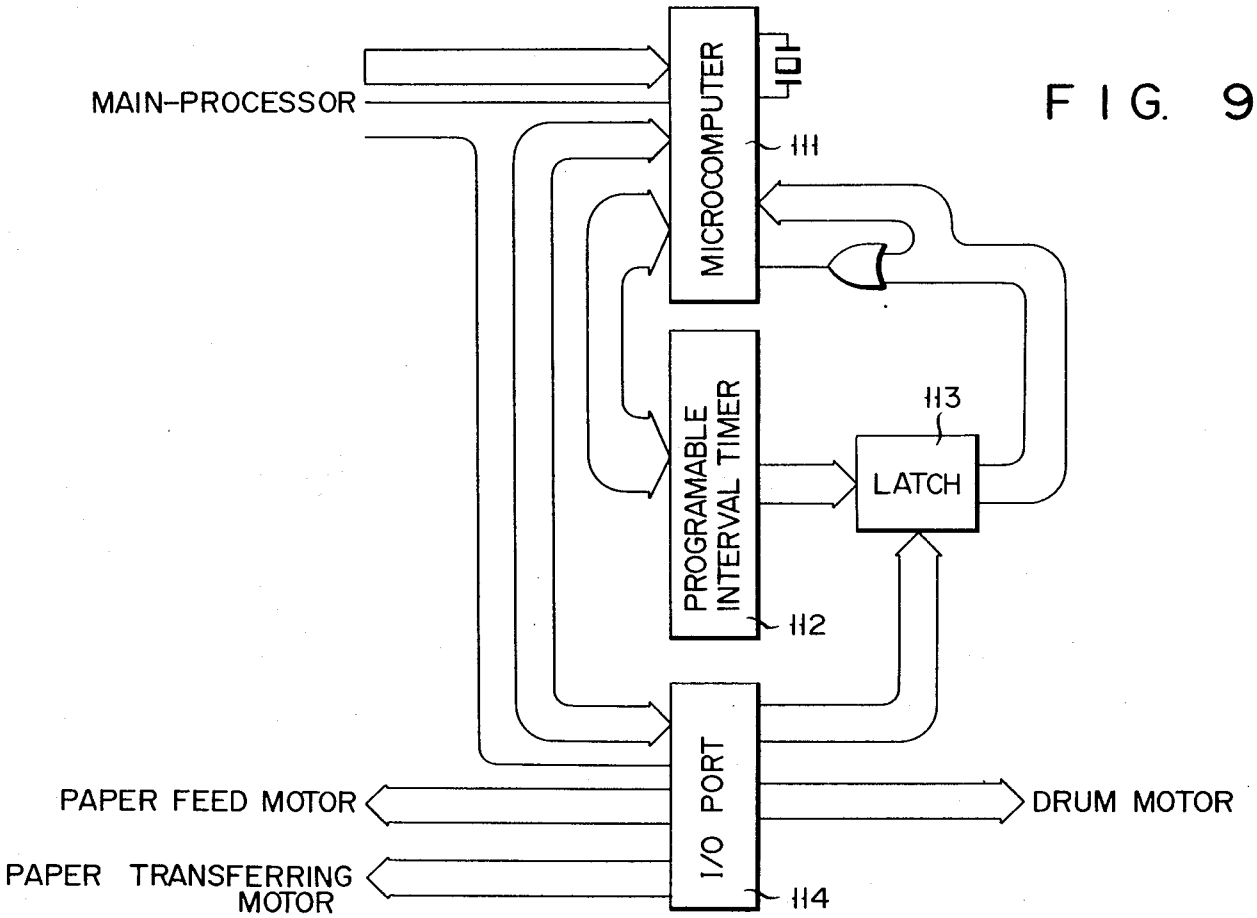

FIG. 9 shows an arrangement of the second sub-processor group 73. Reference numeral 111 denotes a CPU connected to the group 71. Reference numeral 112 denotes a programable interval timer for controlling switching time intervals of the pulse motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80.

FIG. 10 shows a pulse motor control circuit. An I/O port 121 (corresponding to the ports 104 and 114 of FIGS. 7 and 9) is connected to a stepping motor driver 122 (corresponding to the drivers 79 and 80 of FIG. 5). The driver 122 is connected to windings A, $\overline{A}$, B and $\overline{B}$ of a stepping motor 123 (corresponding to the motors 31 to 34, 36, 38 and 39).

FIGS. 11A and 11B show a method of controlling a stepping motor speed. FIG. 11A shows a stepping motor speed curve, and FIG. 11B shows switching intervals. As is apparent from FIGS. 11A and 11B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Figure 12:
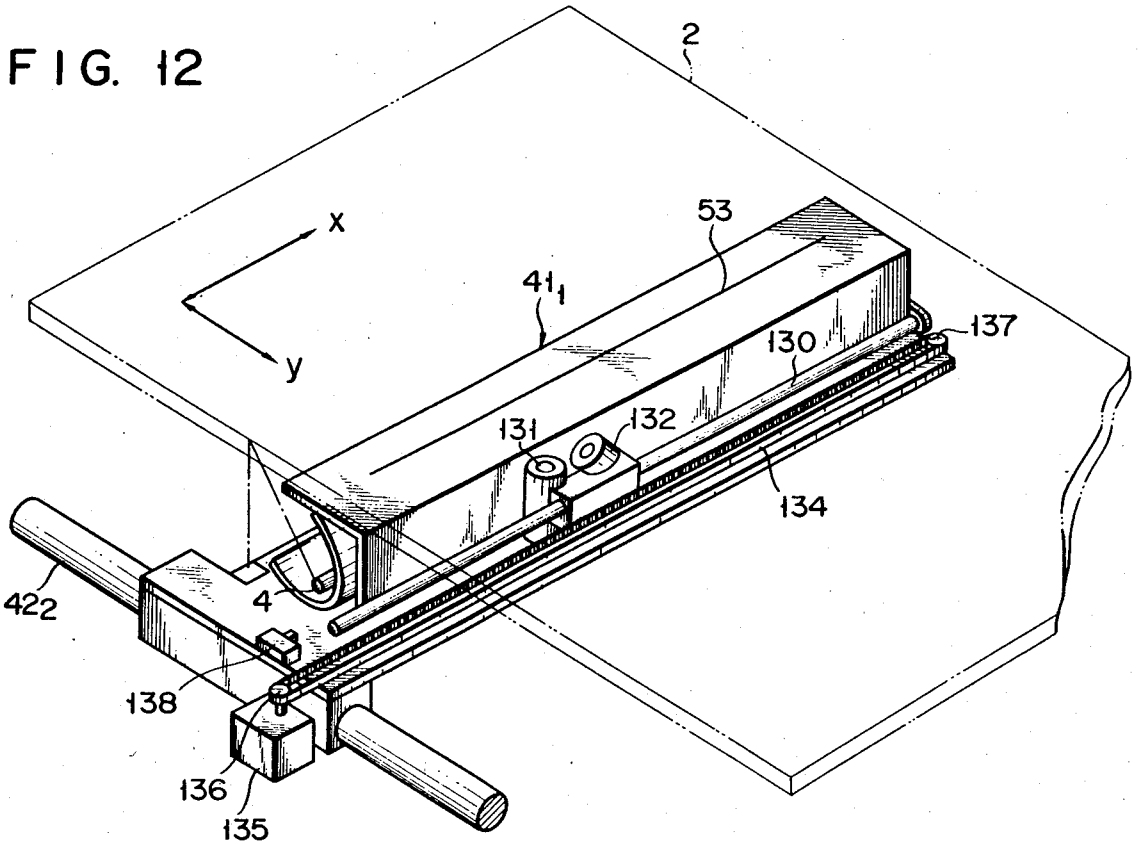
Figure 13:
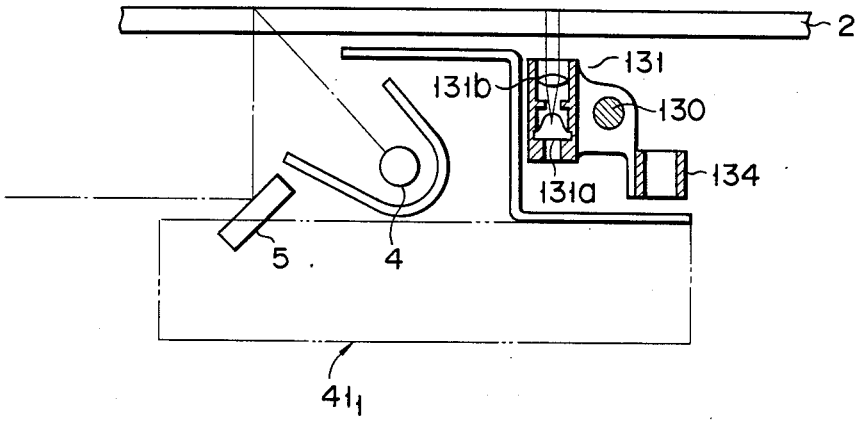
Figure 14:
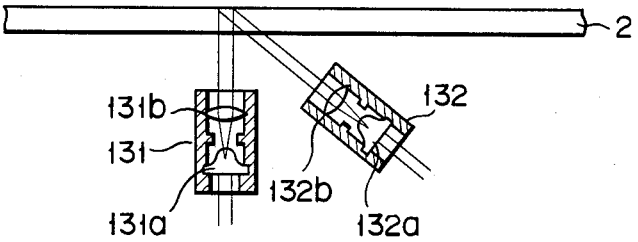

The principal part of the present invention will now be described. Referring to FIGS. 12 to 14, in first carriage $41_1$, guide shaft 130 is arranged along exposure lamp 4 in a portion shielded from light from lamp 4. Light emitting and receiving sections 131 and 132, as a first detection part for detecting a document size, are integrally and movably arranged on shaft 130. Sections 131 and 132 are disposed as shown in FIG. 14. The optical axis of section 131 is set perpendicularly to document table 2. The optical axis of section 132 is inclined to cross the optical axis of section 131 at the surface portion of table 2. Section 131, as a spot light source, comprises light emitting element 131*a*, and lens 131*b* for guiding light emitted from element 131*a* toward table 2. Section 132 comprises light receiving element 132*a*, and lens 132*b* for guiding light reflected from table 2 onto element 132*a*. An ON signal for element 131*a* is supplied from main processor group 71, and an output signal from element 132*a* is supplied to group 71.

Sections 131 and 132 are coupled to timing belt (toothed belt) 134 disposed along guide shaft 130. Belt 134 is looped between driving pulley 136 mounted on a rotating shaft of stepping motor 135 and driven pulley 137. Therefore, when motor 135 is rotated, sections 131 and 132 are moved in a direction perpendicular to the scanning direction of carriage $41_1$. Position sensor 138 comprising a micro switch for detecting initial positions of sections 131 and 132 is provided on an edge portion of carriage $41_1$ at the side of motor 135. For example, when sections 131 and 132 are moved, a lower end portion of section 131 first abuts against sensor 138 and its initial position is then detected.

Figure 15:
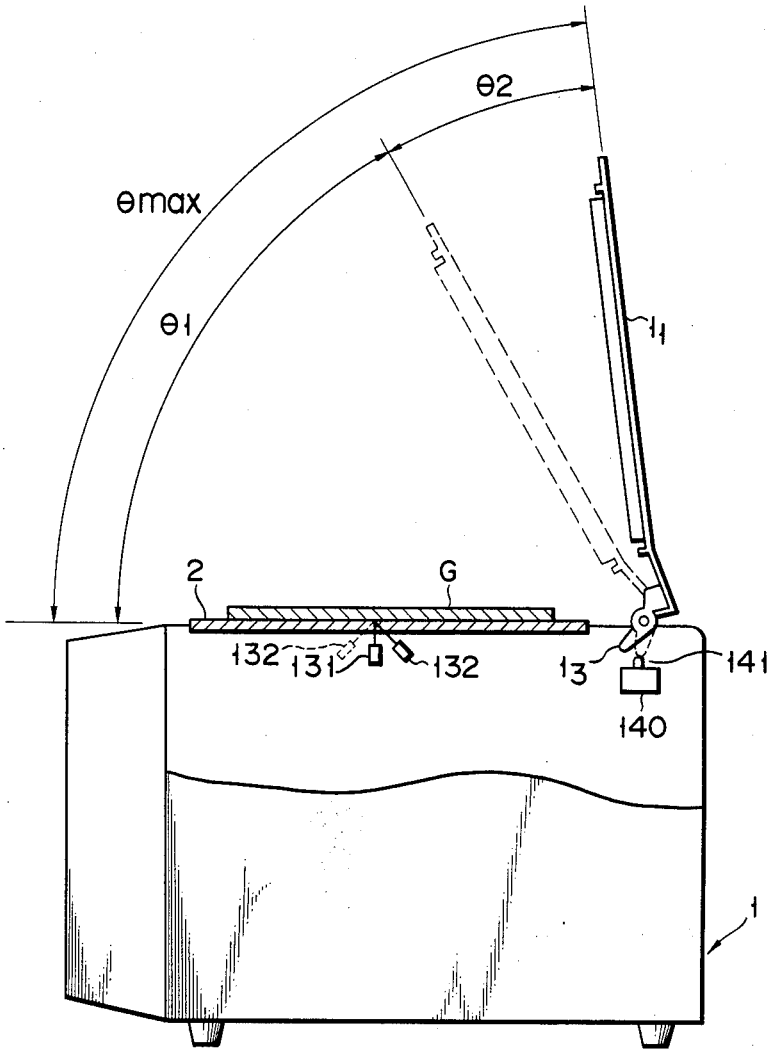

As shown in FIG. 15, pivot shaft $1_3$, which pivots together with document cover $1_1$, is provided at a base end portion of cover $1_1$ inside housing 1. Micro switch 140, as a second detection part for detecting the open/-closed state of cover $1_1$, is provided adjacent to shaft $1_3$. The location of switch 140 is determined as follows. Assuming that a maximum open angle of cover $1_1$ is given by $\theta_{max}$, positions of switch 140 and shaft $1_3$ are defined so that shaft $1_3$ abuts against actuator 141 of switch 140 to turn it on at open angle $\theta_1$. Angle $\theta_2$ ($=\theta_{max}-\theta_1$) is an idle angle of cover $1_1$. Cover $1_1$ in an open state is held in a so-called free stop state by a holding member comprising a spring (not shown) within the range of idle angle $\theta_2$.

Figure 16:
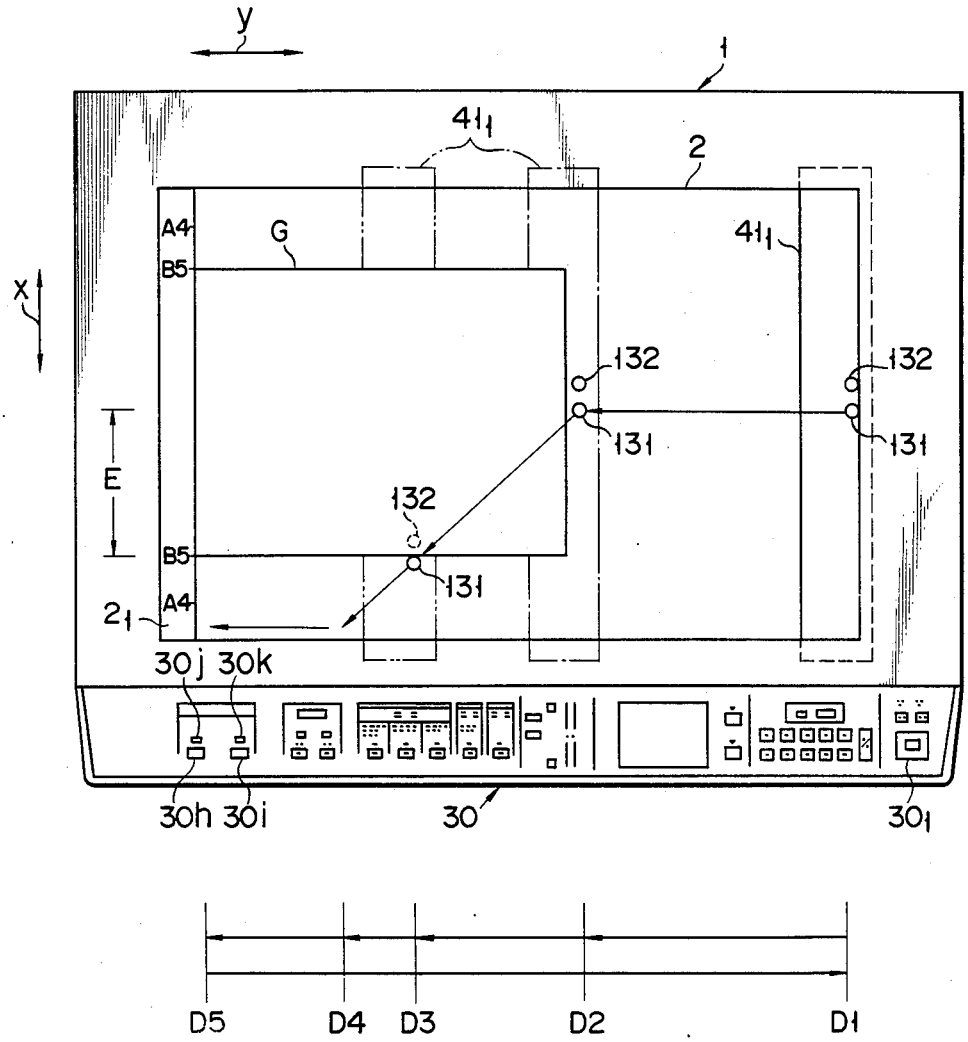

The operation of the apparatus with the above arrangement will be described. Normally, carriage $41_1$ is set in a standby state at a position farthest from stationary scale $2_1$, i.e., at one end in the longitudinal direction of table 2, as shown in FIG. 16. Section 131 as the first detection part is set in a standby state on carriage $41_1$ at substantially the central portion in the lateral direction of table 2. In this state, cover $1_1$ is opened, and document G is set with reference to the central portion of stationary scale $2_1$. For example, check key 30*h* is then operated. Cover $1_1$ is pivoted in a closing direction. When cover $1_1$ is pivoted at angle $\theta_1$, switch 140 is turned on. The ON output from switch 140 is supplied to main processor group 71. Group 71 supplies an ON signal to light emitting element 131*a* of section 131, and a high speed drive instruction signal of carriage $41_1$ to sub-processor group 72. Thus, element 131*a* is illuminated. Carriage $41_1$ is moved at a speed equal to its return speed, i.e., higher than its scanning speed in a copying mode. Sections 131 and 132 are then moved from point $D_1$ toward point $D_5$, as shown in FIG. 16. Light emitted from section 131 passes through table 2 from point $D_1$ to point $D_5$ corresponding to one edge portion of document G placed on table 2. A moving speed of carriage $41_1$ from point $D_1$ to point $D_5$ is set higher than a normal speed of cover $1_1$ when it pivots within angle $\theta_1$. That is until sections 131 and 132 reach point $D_5$, cover $1_1$ is not closed. Therefore, while sections 131 and 132 are moved from point $D_1$ to $D_2$, most of light emitted from section 131 passes through table 2. In this case, light receiving element 132*a* of section 132 is in an OFF state. When sections 131 and 132 reach point $D_2$, light emitted from section 131 is reflected by document G, and becomes incident on section 132. Thus, element 132*a* of section 132 is turned on. Carriage $41_1$ is further moved toward scale $2_1$ from point $D_2$. Motor 135 is then driven in response to the ON output from element 132*a*. Sections 131 and 132 are moved in a direction away from the base end portion of cover $1_1$, as shown in FIG. 16. When section 131 falls outside document G from its other end portion at point $D_3$, element 132*a* is turned off again. In this state, sections 131 and 132 are moved toward the end portion of carriage $41_1$. Upon movement of carriage $41_1$, sections 131 and 132 reach the end portion of carriage $41_1$ at point $D_4$ and are moved to point $D_5$ while maintaining the same positions on carriage $41_1$. The drive pulse number of stepping motor 33 for driving carriage $41_1$ is counted by, e.g., main processor group 71 from when element 132*a* is turned on until sections 131 and 132 reach point $D_5$. The size of document G in the y direction can be detected based on the count. Document G is placed with reference to the central portion of document table 2, and section 131 is positioned at the central portion of table 2 from point $D_1$ to point $D_2$. Therefore, if the drive pulse number of stepping motor 135 for driving sections 131 and 132 is counted by, e.g., main processor group 71 during the ON period of element 132*a*, the size of document G in the x direction can thus be obtained by $2\times E$ (where E is the count).

In the count method for the y direction, the document size cannot be determined unless sections 131 and 132 are moved from point $D_1$ to point $D_5$. Drive pulse number $P_{15}$ of carriage $41_1$ necessary for driving sections 131 and 132 from point $D_1$ to point $D_5$ is stored in main processor group 71 in advance. Drive pulse number $P_{12}$ required until element 132*a* is turned on is subtracted from preset drive pulse number $P_{15}$. In other words, drive pulse number $P_{25}$ corresponding to the size of document G in the y direction can be obtained as follows:

$$P_{25}=P_{15}-P_{12}$$

With the above arrangement, when sections 131 and 132 reach point $D_2$, a document size in the y direction can be detected, thus achieving quick detection.

In this manner, size data $P_{Gx}$ and $P_{Gy}$ in the x and y directions of document G is detected. Copying magnification data Kx and Ky can be calculated by main processor group 71 with reference to detected document size data $P_{Gx}$ and $P_{Gy}$, size data Py in the y direction (a paper feed direction) of a selected paper sheet and size data Px in the x direction (a direction perpendicular to the paper feed direction). That is, copying magnification data Kx and Ky can be obtained from the following relations:

$$Kx=Px/P_{Gx}$$

$$Ky=Py/P_{Gy}$$

It should be noted that paper size data Px and Py is stored in memory 85 when a paper size is selected. Copying magnification data Kx or Ky most suitable for copying a document image on a selected paper sheet is determined as follows. Assume that an A4-size document is placed so that its longitudinal direction is arranged along stationary scale $2_1$, and a B5-size paper sheet is set to have its longitudinal direction aligned along the paper feed direction. In this case, since copying magnification data Ky obtained with reference to the document size in the y direction corresponds to the enlargement copying mode, it is difficult to copy the document image within the paper sheet range. When copying magnification data Kx obtained with reference to the document size in the x direction is used, the reduction copying operation will be performed. Therefore, the entire document image can be copied on the sheet unlike the case of data Ky. In other words, a smaller one of copying magnification data Kx and Ky is selected as an optimum copying magnfication. The selected copying magnification is displayed on display $30_8$ on control panel 30. Therefore, the user must select a magnfication suited for the displayed value by magnification setting key $30_6$ or zoom key $30_7$.

Assuming that automatic magnification change key 30*i* is operated instead of check key 30*h* and cover $1_1$ is then closed when document G is placed on table 2. In this case, the optimum copying magnfication is obtained in the same manner as described above. Motors 31, 32, and the like are driven to automatically set the obtained optimum copying magnification, and lens block 8, mirrors 5 and 6, and the like are then moved.

As described above, when key 30*h* or 30*i* is operated, carriage $41_1$ is moved toward scale $2_1$, and sections 131 and 132 are stopped at a position corresponding to point $D_5$. The stop position of carriage $41_1$ coincides with a copy start position. After check key 30*h* is operated, when copy key $30_1$ is operated, exposure lamp 4 is illuminated, and carriage $41_1$ is moved in a direction away from scale $2_1$. Thus, a copying operation is performed at an equal magnification or a manually set magnification. After automatic magnification change key 30*i* is operated, when copy key $30_1$ is operated, the copying operation is performed at an automatically set optimum copying magnification. When the copying operation ends, carriage $41_1$ and section 132 are set in the standby state at a position indicated by point $D_1$ in FIG. 16. After key 30*h* or 30*i* is operated, when key $30_1$ is not operated for a predetermined period of time, carriage $41_1$ and sections 131 and 132 are moved to a position indicated by point $D_1$ shown in FIG. 16, and are set in the standby state.

In the above description, the stop position of carriage $41_1$ at sclae $2_1$ side coincides with the copy start position. In practive, however, since a predetermined length is required for setting carriage $41_1$ at a constant speed after the copying operation starts, a margin therefor is needed.

In a normal copying mode, the ON output from switch 140 is ignored. In response to the operation of key $30_1$, carriage $41_1$ is first moved from point $D_1$ to point $D_5$ at high speed, and is then moved toward point $D_1$ at a normal copying speed. After the copying operation, as shown in FIG. 16, carriage $41_1$ is returned to and stopped at point $D_1$.

According to the first embodiment, first carriage $41_1$ comprises light emitting and receiving section 131 and 132 as the first detection means so as to be movable in a direction perpendicular to the moving direction of carriage $41_1$. In response to a change in output signal from light receiving section 132, a document size is detected. Therefore, size (dimensions) in the x and y directions of a document can be detected at the same time. Furthermore, an optimum copying magnification is obtained with reference to the detected document size in the x and y directions and the paper size of a selected sheet. For this reason, not only a rated size document but also an unrated size document can be easily copied without partial omission of a document image.

The document size is detected when cover $1_1$ is being closed from the open state. For this reason, a light amount incident on section 132 is greatly changed depending on the presence/absence of the document.

Therefore, detection precision of document size can be improved. Sections 131 and 132 are moved in a direction away from the base end portion of cover $1_1$ upon closing of cover $1_1$. Hence, a time required for detecting a document size can be shortened.

Furthermore, a document size is detected upon closing of the document cover. For this reason, the document size can be quickly detected and the copying operation can be immediately started, resulting in excellent operability.

Carriage $41_1$ normally awaits at the other end portion of document table 2 separated from scale $2_1$. For this reason, upon operation of key 30*h* or 30*i*, the document size can be detected at high speed.

Furthermore, since a document size detection mechanism does not require a plurality of light emitting and receiving elements as in a conventional apparatus, the number of parts can be reduced. In addition, in the detection mechanism, since light emitting and receiving sections 131 and 132 are arranged on first carriage $41_1$, an installation space for parts can also be reduced.

Note that micro switch 140 is used as the second detection part. However, the second detection part is not limited to this. For example, the second detection means can be a photocoupler for optically detecting movement of pivot shaft $1_3$.

A second embodiment will now be described. A copying machine according to the second embodiment have substantially the same arrangement as that of the first embodiment shown in FIGS. 1 to 15 excluding a panel arrangement of FIG. 3 and a control unit arrangement of FIG. 6, and a detailed description thereof will be omitted.

Figure 17:
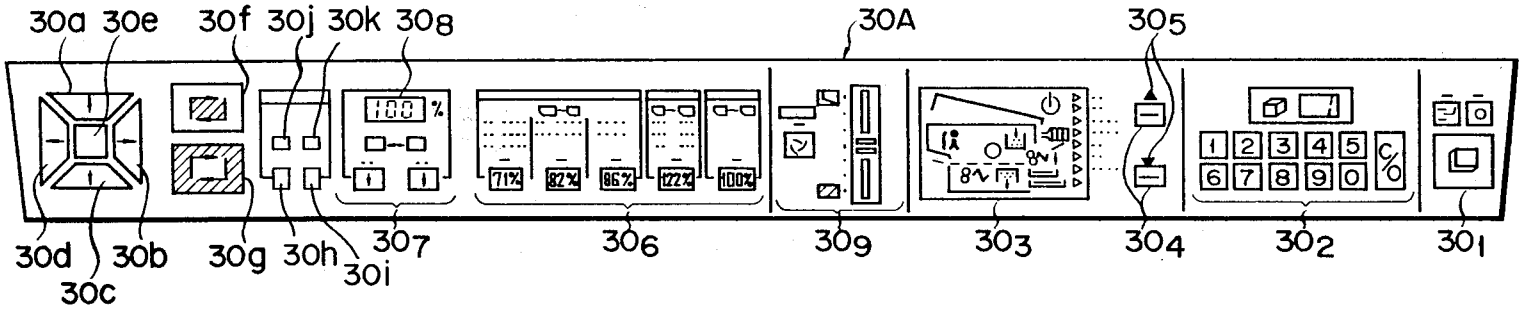

FIG. 17 shows a panel arrangement of the second embodiment. Reference numerals 30*a*, 30*b*, 30*c*, and 30*d* at the left end of control panel 30A denote control keys for moving a spot light source indicating an erasure position of a document (to be described later); 30*e*, a position designation key for inputting a coordinate position indicated by the spot light source; and 30*f* and 30*g*, erasure range designation keys for designating an erasure range at a designated position. The remaining arrangement of panel 30A is the same as that shown in FIG. 3 according to the first embodiment.

Figure 18:
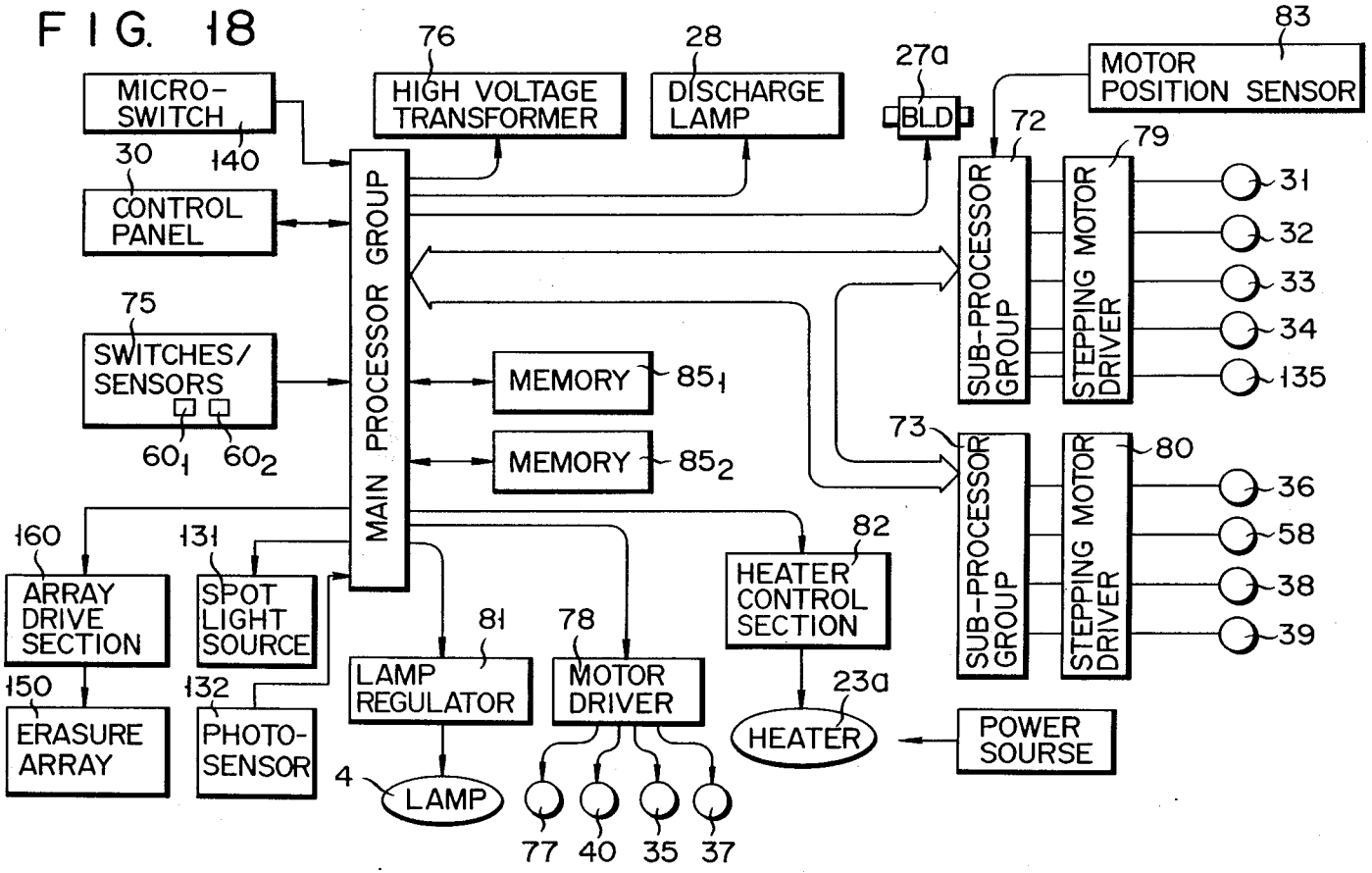

FIG. 18 shows the overall control circuit of the second embodiment. The control circuit performs the same operation as that of FIG. 6 except that it controls erasure array 150 and array drive section 160 shown in the lower left portion of FIG. 18 and memory $85_2$ shown in the central portion thereof by main processor group 71 so as to erase an unnecessary portion in the copying mode from a document image. However, memory 85 shown in FIG. 6 corresponds to memory $85_1$ in FIG. 18.

As can be seen from FIG. 18, the second embodiment is applied to a copying machine which has an erasure function of an unnecessary portion in the copying mode in addition to the same document size detection function as that of the first embodiment.

Figure 19:
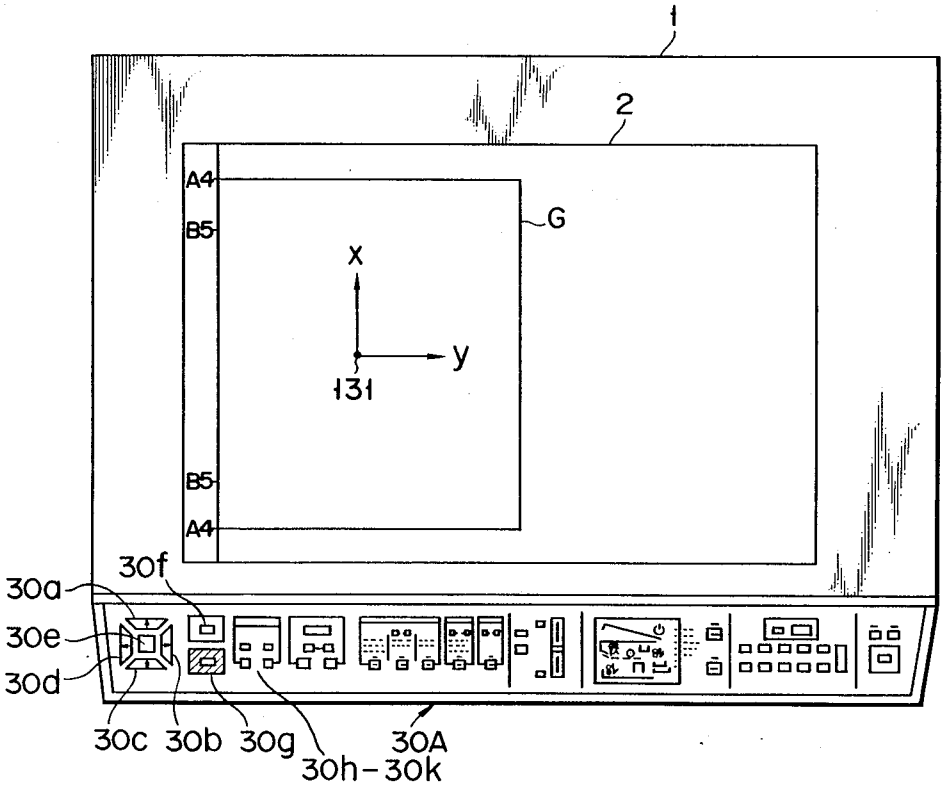
Figure 20:
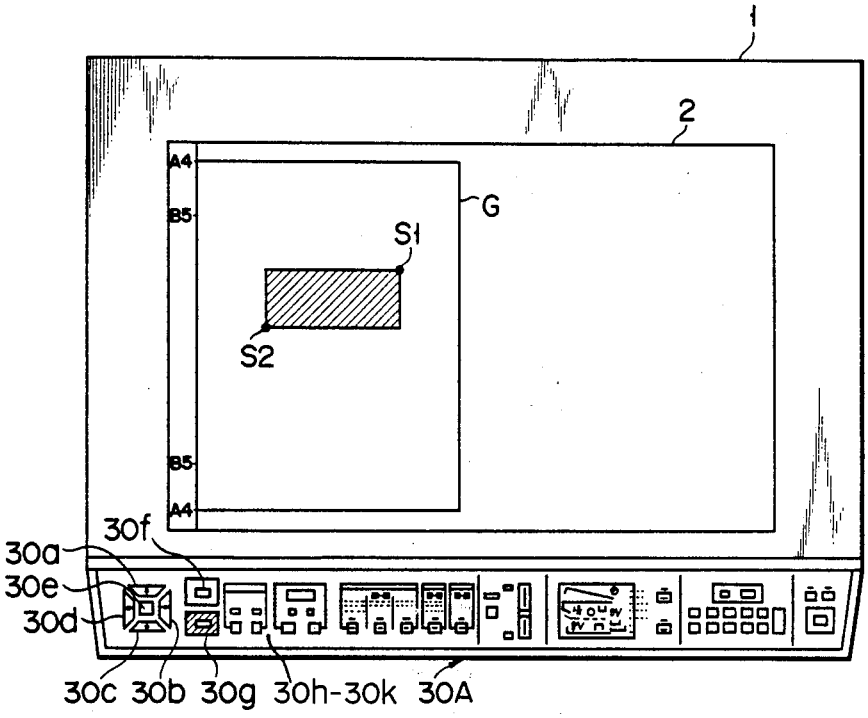
Figure 21:
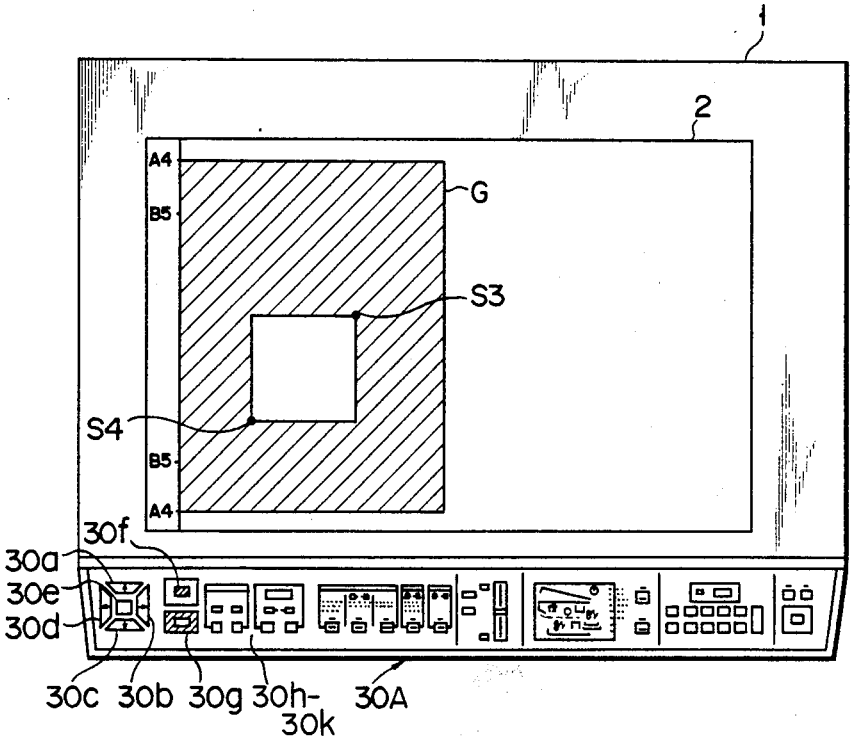
Figure 22A:
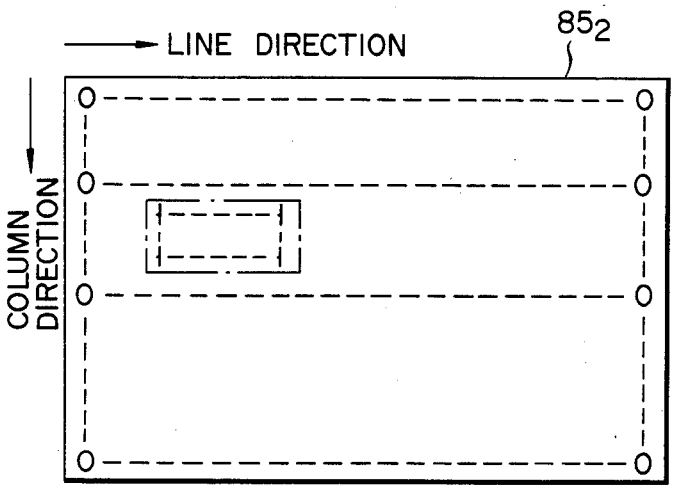
Figure 22B:
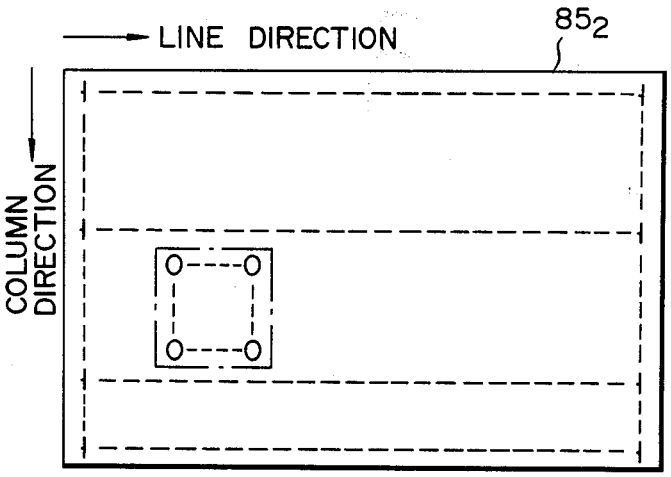

A method for designating an unnecessary portion of a document image in the copying mode as an erasure range using spot light source 131 will be described with reference to FIGS. 19 to 21. Spot light source 131 is moved by operating control keys 30*a* to 30*d*. After document G is placed as above, before document cover $1_1$ is closed, control keys 30*b* and 30*d* are depressed. Thus, motor 33 is driven, and first carriage $41_1$ and sport light source 131 are moved in the scanning direction (in the y direction of arrow in FIG. 19) from point $D_1$ shown in FIG. 16. When control keys 30*a* and 30*c* are depressed, motor 135 is driven, and light source 131 is moved in a direction perpendicular to the scanning direction (in the x direction of arrow in FIG. 19). Thus, an operator operates keys 30*a* to 30*d* to move light source 131 below document G. He again operates keys 30*a* to 30*d* as needed while visually observing spot light passing through document G, thereby moving the sport light, e.g., to point $S_1$ on document G shown in FIG. 20. In this state, when the operator depresses position designation key 30*e*, coordinate position data designated by point $S_1$ is fetched in main processor group 71 shown in FIG. 18. Similarly, after the spot light is moved at point $S_2$ on document G, when key 30*e* is depressed, position data corresponding to point $S_2$ is fetched in group 71. Position data of points $S_1$ and $S_2$ can be detected by counting the drive pulse number of stepping motors 33 and 135. When erasure range designation key 30*f* is depressed, a rectangular region (indicated by hatching) with points $S_1$ and $S_2$ as diagonal points is designated as an erasure range, as shown in FIG. 20. As shown in FIG. 21, when points $S_3$ and $S_4$ are designated and erasure range designation key 30*g* is depressed, a portion except for a square region with points $S_3$ and $S_4$ as diagonal points is designated as an erasure range. In this manner, when key 30*f* or 30*g* is depressed, a predetermined calculation is performed by main processor group 71 based on data corresponding to two designated points. In accordance with the calculation result, a HIGH level "1" signal is stored in an erasure range area of memory $85_2$ and a LOW level "0" signal is stored in the other area thereof. In this case, memory $85_2$ comprises a RAM wherein a capacity in each line direction substantially coincides with (a moving distance of light source 131 in the x direction)÷(a positional resolution in the x direction), and a capacity in each column direction substantially coincides with (a moving distance of light source 131 in the y direction)÷(a positional resolution in the y direction). In the cases of FIGS. 20 and 21, memory $85_2$ stores the HIGH level "1" signal corresponding to the hatched portion and the LOW level "0" signal corresponding to the other portion, as shown in FIGS. 22A and 22B, respectively.

Figure 23A:
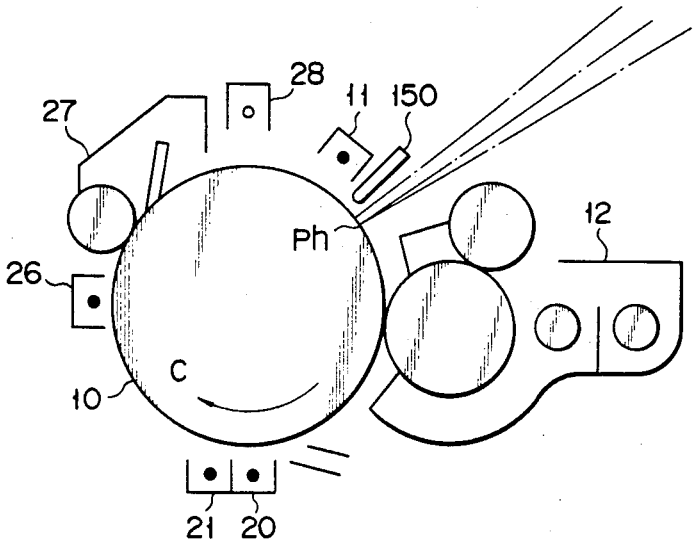
FIG. 23A is a side sectional view of the principal part showing an arrangement of the erasure array.
Figure 24:
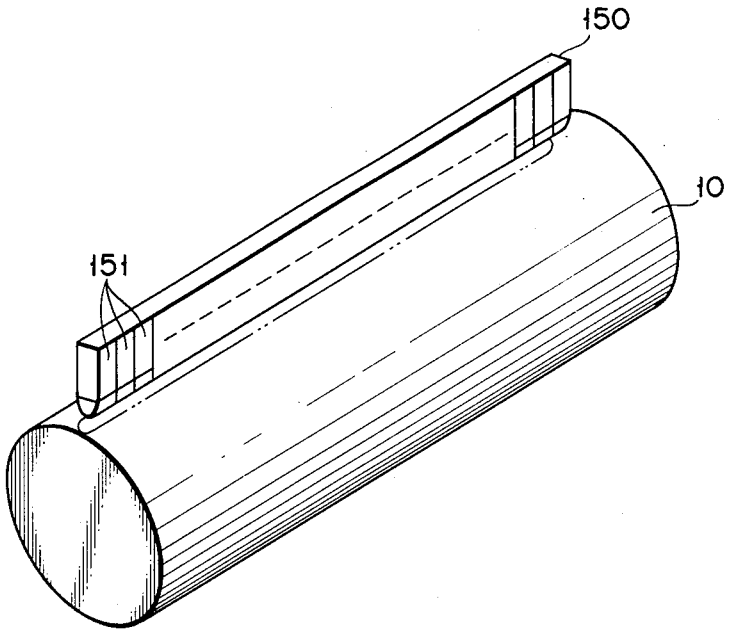
Figure 25:
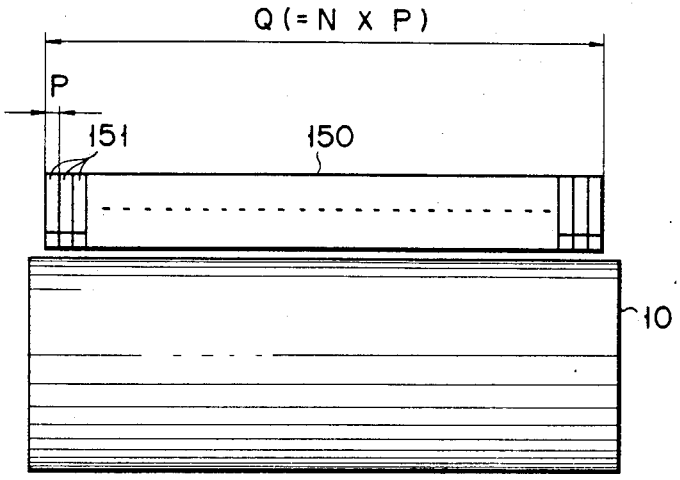
Figure 26A:
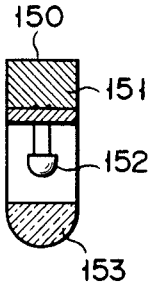
FIG. 26A is a side sectional view of the erasure array.
Figure 26B:
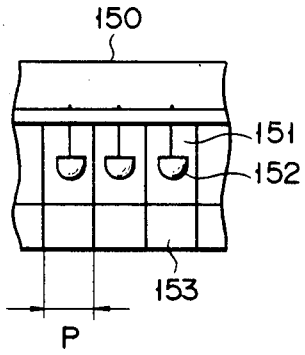
FIG. 26B is a partial front view of the erasure array.

As shown in FIG. 23A, on the other hand, the erasure array 150 as the erasing means is disposed close to the photosensitive drum 10, between the charger 11 and an exposure region Ph, for example. As shown in FIGS. 24 and 25, the erasure array 150 includes a plurality of shading cells 151 which are arranged in a direction perpendicular to the rotating direction of the photosensitive drum 10. As shown in FIGS. 26A and 26B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light emitting elements 152 arranged in the erasure array 150 is equivalent to, for example, the column-direction capacity of the memory $85_2$. If the distance between each two adjacent light emitting elements 152 and the number of light emitting elements 152 are P and N, respectively, the overall length Q of the erasure array 100 is $Q=N \cdot P$.

Figure 27:
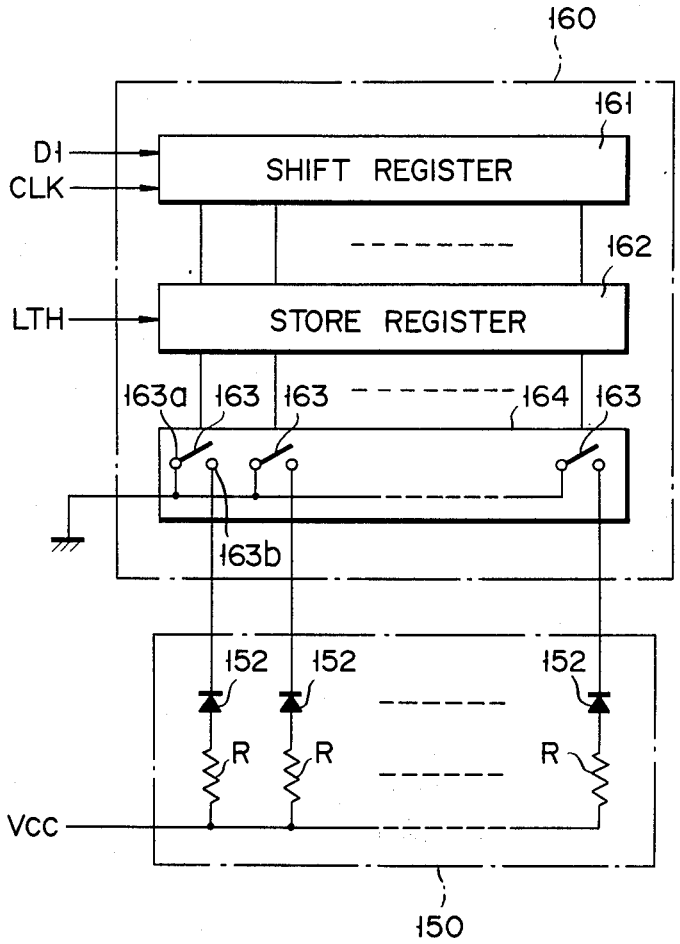

The array 150 is driven by an array drive section 160. As shown in FIG. 27, the section 160 comprises a shift register 161 having the same bit number as the rank bit number of the memory $85_2$, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After an unnecessary portion of the original is specified as the erasure area, he closes the original cover $1_1$ and depresses the key $30_1$. Thereafter, the carriage $41_1$ is moved, and the photosensitive drum 10 is driven accordingly. One-rank data are sequentially read out along the line direction (FIGS. 22A and 22B) of the memory $85_2$. The readout data $D_1$ are transferred to the register 161 in the section 160 in response to the clock signal CLK. After one-rank data is transferred to the register 161 and the charged portion of the drum 10 reaches the array 150, the group 71 geneates a latch signal LTH. The storage data is supplied from the register 161 to the register 162 in rsponse to the latch signal LTH. Since the array 150 is arranged between the charger 11 and the exposure portion Ph, the output timing of the latch signal LTH is controlled such that the one-rank data is transferred from the memory $85_2$ to the register 162 prior to $\theta 1/\omega$ where $\theta 1$ is the angle between the array 150 and the portion Ph and $\omega$ is the peripheral velocity of the drum 10. The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank is erased. The data is thus read out from the memory 140 in units of ranks, thereby erasing the unnecessary image portion.

According to the second embodiment of the present invention, the unnecessary portion of a document image can be designated by spot light souce 131 and erased, in addition to the advantage of document size detection described in the first embodiment. Therefore, it is convenient for editting copied images.

Furthermore, spot light source 131 is arranged on first carriage $41_1$, and is used both for document size detection and document erasure range designation. Therefore, an inner space of an apparatus can be effectively utilized, and the apparatus can be rendered compact.

Figure 23B:
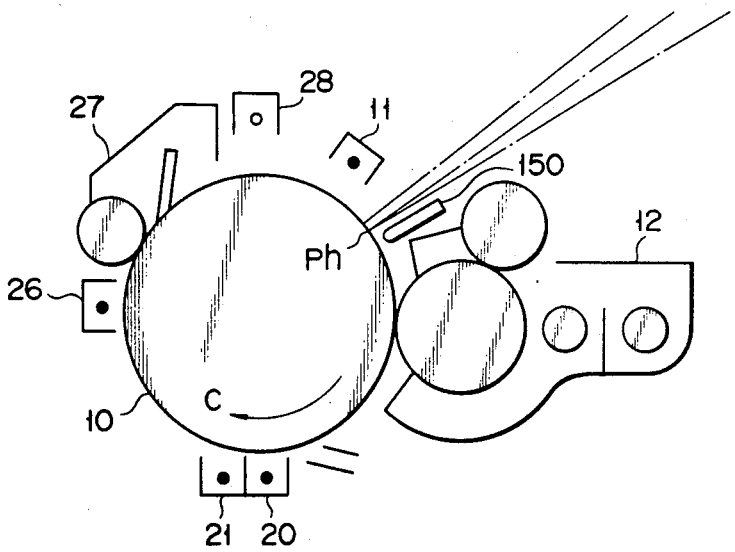
FIG. 23B is a side sectional view of the principal part showing another arrangement of the erasure array.

In the second embodiment, erasure array 150 need not be interposed between charger 11 and exposure section Ph shown in FIG. 23A, but can be interposed between section Ph and developer 12, as shown in FIG. 23B so as to erase a latent image in accordance with designation.

Various changes and modifications may be made within the spirit and scope of the invention.

For example, light receiving section 132 can be provided at the position indicated by broken lines in FIG. 15. In this case, cover $1_1$ moving to the closed position reduces the amount of the excessive light incident to section 132, and the size of the original will be more accurately detected.

According to the present invention, a simple image forming apparatus, which can accurately detect two dimensions of a document, and, an image forming apparatus, which can selectively erase an unnecessary portion of a document in a copying mode in addition to the above feature, can be provided.

What is claimed is:

1. An image forming apparatus with document size detection, said apparatus comprising:

a document table on which a document subjected to image formation is placed at one end side thereof;

image formation instruction means for supplying an image formation instruction;

document scanning means, movable along said document table, for scanning the document from the one end side to the other end side of said document table to obtain image data in accordance with the image formation instruction;

light emitting and receiving means provided on said document scanning means to be movable along a direction perpendicular to a moving direction of said document scanning means, and including a light emitting section for emitting light in a direction of said document table and a light receiving section for receiving a reflected component of light emitted by said light emitting section;

first control means for, in an initial state, setting said document scanning means at a predetermined initial position of said document table and setting said light emitting and receiving means at a predetermined initial position on said document scanning means;

document size detection instruction means for supplying a document size detection instruction prior to the image formation instruction;

second control means for moving said document scanning means from the predetermined initial position in accordance with the document size detection instruction;

first detection means for detecting a change in amount of light received by said light receiving section, when said light emitting and receiving means has reached one side portion of the document, upon movement of said document scanning means by said second control means;

third control means for moving said light emitting and receiving means from the predetermined initial position in accordance with the detection signal from said first detection means;

second detection means for detecting, upon movement of said document scanning means and said light emitting and receiving means by said first and third control means, a change in amount of light received by said light receiving section when said light emitting and receiving means has reached the other side portion of the document;

document size calculation means for calculating two dimensions of the document based on the detection signals from said first and second detection means;

image forming means for transferring the image data from said document scanning means onto an image forming medium at a predetermined magnification; and fourth control means for generating a control signal required for at least one of said document scanning means and said image forming means based on the calculation result from said document size calculation means.

2. An apparatus according to claim 1, wherein said apparatus further comprises:

a document cover arranged on said document table to be freely opened/closed; and document cover state detection means for detecting that said document cover is being shifted from an open state to a close state, the detection result from said document cover state detection means substantially acting as the document size detection instruction.

3. An apparatus according to claim 2, wherein said light emitting section of said light emitting and receiving means emits light in accordance with the detection result from said document cover state detection means.

4. An apparatus according to claim 2, wherein said document cover state detection means detects that said document cover shifts from the open to close state while said document cover is closed by a predetermined idle angle from a state representing a maximum open angle.

5. An apparatus according to claim 1, wherein said document scanning means, in a document size detection mode, is moved at a speed higher than in a normal document scanning mode.

6. An apparatus according to claim 1, wherein the predetermined initial position of said document scanning means set by said first control means is at the other end side of said document table.

7. An apparatus according to claim 1, wherein the predetermined initial position of said light emitting and receiving means set by said first control means is at a central portion of said document scanning means.

8. An apparatus according to claim 1, wherein said fourth control means includes:

means for calculating optimum transfer magnification data of the image data based on the calculated document size data and size data of the image forming medium stored in advance.

9. An apparatus according to claim 8, wherein said apparatus further comprises:

display means for displaying the calculated optimum transfer magnification data; and transfer magnification setting means for manually setting transfer magnification data corresponding to the displayed optimum transfer magnification data with respect to said image forming means.

10. An apparatus according to claim 8, wherein said apparatus further comprises:

fifth control means for automatically setting transfer magnification data corresponding to the calculated optimum transfer magnification data with respect to said image forming means; and automatic magnification change mode instruction means for supplying an automatic setting instruction to said fifth control means.

11. An image forming apparatus with document size detection and image forming area selection, said apparatus comprising:

a document table on which a light transmissive document subjected to image formation is placed at one end side thereof;

image formation instruction means for supplying an image formation instruction;

document scanning means, movable along said document table, for scanning the document from one end side toward the other end side of said document table in response to the image formation instruction so as to obtain image data;

light emitting and receiving means provided on said document scanning means to be movable along a direction perpendicular to a moving direction of said document scanning means, and including a light emitting section for emitting light in a direction of said document table, and a light receiving section for selectively receiving a reflected component of light emitted by said light emitting section;

first control means for, in an initial state, setting said document scanning means at a predetermined initial position on said document table and setting said light emitting and receiving means at a predetermined initial position on said document scanning means;

document size detection instruction means for supplying a document size detection instruction prior to the image formation instruction;

second control means for moving said document scanning means from the predetermined initial position in response to the document size detection instruction;

first detection means for detecting a change in amount of light received by said light receiving section when said light emitting and receiving means has reached one side portion of the document upon movement of said document scanning means by said second control means;

third control means for moving said light emitting and receiving means from the predetermined initial position in response to a detection signal from said first detection means;

second detection means for detecting, upon movement of said document scanning means and said light emitting and receiving means by said second and third control means, a change in amount of light received by said light receiving section when said light emitting and receiving means has reached the other side portion of the document;

document size calculation means for calculating two dimensions of the document based on the detection signals from said first and second detection means;

image forming means for transferring the image data from said document scanning means on an image forming medium at a predetermined transfer magnification;

fourth control means for generating a control signal required for controlling at least one of said document scanning means and said image forming means based on the calculation result from said document size calculation means;

erasure portion designating means for supplying, prior to the image formation instruction, a position change instruction for changing a position of a transmission light component so that an unnecessary portion on the document is designated as an erasure portion by the position of the transmission light component on the document emitted from said light emitting section of said light emitting and receiving means;

fifth control means for moving said document scanning means and said light emitting and receiving means from the respective predetermined initial positions in response to the position change instruction of the transmission light component;

erasure portion storing means for storing position data representing a position of the erasure portion designated by said erasure portion designating means;

image erasure means for selectively erasing the image data to be transferred by said image forming means; and sixth control means for fetching, in a transferring operation by said image forming means, the position data of the erasure portion from said erasure portion storing means so as to supply the readout data to said image erasure means.

12. An apparatus according to claim 11, wherein said apparatus further comprises:

a document cover arranged on said document table to be freely opened/closed; and document cover state detection means for detecting that said document cover is being shifted from an open state to a close state, the detection result from said document cover state detection means substantially acting as the document size detection instruction.

13. An apparatus according to claim 12, wherein said light emitting section of said light emitting and receiving means emits light in accordance with the detection result from said document cover state detection means.

14. An apparatus according to claim 12, wherein said document cover state detection means detects that said document cover shifts from the open to close state while said document cover is closed by a predetermined idle angle from a state representing a maximum open angle.

15. An apparatus according to claim 11, wherein said document scanning means, in a document size detection mode, is moved at a speed higher than in a normal document scanning mode.

16. An apparatus according to claim 11, wherein the predetermined initial position of said document scanning means set by said first control means is at the other end side of said document table.

17. An apparatus according to claim 11, wherein the predetermined initial position of said light emitting and receiving means set by said first control means is at a central portion of said document scanning means.

18. An apparatus according to claim 11, wherein said fourth control means includes:

means for calculating optimum transfer magnification data of the image data based on the calculated document size data and size data of the image forming medium stored in advance.

19. An apparatus according to claim 18, wherein said apparatus further comprises:

display means for displaying the calculated optimum transfer magnification data; and transfer magnification setting means for manually setting transfer magnification data corresponding to the displayed optimum transfer magnification data with respect to said image forming means.

20. An apparatus according to claim 18, wherein said apparatus further comprises:

seventh control means for automatically setting transfer magnification data corresponding to the calculated optimum transfer magnification data with respect to said image forming means; and automatic magnification change mode instruction means for supplying an automatic setting instruction to said seventh control means.

21. An apparatus according to claim 11, wherein said erasure portion designating means includes means for calculating the position data representing the erasure portion with reference to the position data from said document scanning means and said light emitting and receiving means, and means for supplying a storage instruction to said erasure portion storing means so as to store therein the position data, calculated by said calculating means, representing the erasure portion.

22. An apparatus according to claim 11, wherein said image erasure means includes a plurality of light emitting elements lineary arranged to face said image forming means.

23. An apparatus according to claim 22, wherein said plurality of light emitting elements are set at a position that enables selective light emission to said image forming means in an image forming process by said image forming means.

24. An apparatus according to claim 22, wherein said plurality of light emitting elements are set at a position that enables selective light emission to said image forming means in a developing process by said image forming means.

* * * * *